US009376255B2

(12) United States Patent
Banik et al.

(10) Patent No.: US 9,376,255 B2
(45) Date of Patent: Jun. 28, 2016

(54) WASTE CONTAINER WITH GRAVITY LATCH

(71) Applicant: Orbis Corporation, Oconomowoc, WI (US)

(72) Inventors: Joachim Banik, Oconomowoc, WI (US); Paul Mans, Fort Atkinson, WI (US); Mark D. Schaefer, Oconomowoc, WI (US); James Marschalek, Hartland, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 14/184,006

(22) Filed: Feb. 19, 2014

(65) Prior Publication Data

US 2014/0238990 A1 Aug. 28, 2014

Related U.S. Application Data

(60) Provisional application No. 61/768,049, filed on Feb. 22, 2013.

(51) Int. Cl.
*B65F 1/14* (2006.01)
*E05B 15/00* (2006.01)

(52) U.S. Cl.
CPC ..... *B65F 1/1615* (2013.01); *E05B 15/0093* (2013.01)

(58) Field of Classification Search
CPC ..... B65F 1/1615; E05B 15/0093
USPC ..... 220/324, 326, 835, 908
See application file for complete search history.

(56) References Cited

U.S. PATENT DOCUMENTS

| | | | | |
|---|---|---|---|---|
| 1,742,075 | A | 12/1929 | Houghten | |
| 3,257,157 | A * | 6/1966 | Jay | 312/328 |
| 3,825,150 | A | 7/1974 | Taylor | |
| 3,916,456 | A | 11/1975 | Persson | |
| 4,180,176 | A * | 12/1979 | Galer | 217/57 |

(Continued)

FOREIGN PATENT DOCUMENTS

| | | |
|---|---|---|
| CA | ID99947 | 7/2003 |
| CA | 2372465 A1 | 8/2003 |

(Continued)

OTHER PUBLICATIONS

Franzen International Security Products, Inc.; "Trash Bin Gravity Lock"; retrieved on Feb. 20, 2014 from http://www.franxenint.com/trash-bin-gravity-locks.html (1 page).

(Continued)

*Primary Examiner* — Fenn Mathew
*Assistant Examiner* — Elizabeth Volz
(74) *Attorney, Agent, or Firm* — Nixon Peabody LLP

(57) ABSTRACT

A waste container having a body and a lid pivotably connected to the body. The lid includes a gravity activated locking mechanism having a latch that engages the lid to the body when the container is in an upright position. The locking mechanism rotates to disengage the latch and allow the lid to open when the container is inverted for dumping the waste. The waste container further including a slideable member that is engageable with a locking member when the container is not in an upright position or inverted for dumping, to prevent rotation of the locking mechanism and opening of the lid.

20 Claims, 11 Drawing Sheets

(56) References Cited

U.S. PATENT DOCUMENTS

| | | | | |
|---|---|---|---|---|
| 4,182,530 | A | 1/1980 | Hodge | |
| 4,349,121 | A | 9/1982 | Lafferty | |
| D291,738 | S | 9/1987 | Orlowski | |
| 4,753,367 | A | 6/1988 | Miller et al. | |
| 4,967,927 | A | 11/1990 | Reiland et al. | |
| 4,984,561 | A | 1/1991 | Warrington | |
| 4,992,018 | A | 2/1991 | Prout et al. | |
| 5,035,563 | A | 7/1991 | Mezey | |
| 5,056,979 | A | 10/1991 | Niederer et al. | |
| D323,912 | S | 2/1992 | Delmerico | |
| 5,085,341 | A * | 2/1992 | Hodge | 220/811 |
| 5,088,750 | A | 2/1992 | Beese et al. | |
| D324,595 | S | 3/1992 | Beese et al. | |
| 5,094,358 | A | 3/1992 | Serio, Sr. | |
| 5,094,487 | A | 3/1992 | Drewry | |
| 5,103,994 | A * | 4/1992 | Doxey et al. | 220/324 |
| 5,104,198 | A | 4/1992 | Prout et al. | |
| 5,104,200 | A | 4/1992 | Prout et al. | |
| 5,149,153 | A * | 9/1992 | Drewry et al. | 292/104 |
| 5,160,063 | A | 11/1992 | Bailey | |
| 5,163,805 | A | 11/1992 | Mezey | |
| 5,169,012 | A | 12/1992 | Labrie | |
| 5,183,180 | A | 2/1993 | Hawkins et al. | |
| 5,184,836 | A | 2/1993 | Andrews, Jr. | |
| 5,199,592 | A | 4/1993 | Reiland et al. | |
| 5,205,698 | A | 4/1993 | Mezey | |
| 5,224,744 | A * | 7/1993 | Michelutti | 292/234 |
| D345,837 | S | 4/1994 | Bean | |
| 5,303,841 | A | 4/1994 | Mezey | |
| D347,095 | S | 5/1994 | Apps et al. | |
| 5,377,858 | A | 1/1995 | Morris, Sr. | |
| D355,741 | S | 2/1995 | Craft et al. | |
| 5,415,314 | A | 5/1995 | McCollum | |
| 5,445,397 | A | 8/1995 | Evans | |
| D365,428 | S | 12/1995 | Prout et al. | |
| 5,474,341 | A | 12/1995 | Putman et al. | |
| 5,503,292 | A | 4/1996 | Cuccharia | |
| 5,538,158 | A | 7/1996 | Prout et al. | |
| 5,547,104 | A | 8/1996 | Parker | |
| 5,555,996 | A | 9/1996 | Lang-Ree et al. | |
| D374,530 | S | 10/1996 | Prout et al. | |
| 5,582,322 | A | 12/1996 | Prout et al. | |
| 5,585,419 | A | 12/1996 | Prout et al. | |
| D388,577 | S | 12/1997 | Rehrig et al. | |
| 5,772,264 | A * | 6/1998 | Bettenhausen | 292/130 |
| D398,120 | S | 9/1998 | Rehrig et al. | |
| 5,816,591 | A | 10/1998 | Parker et al. | |
| D401,727 | S | 11/1998 | Weideman et al. | |
| 5,881,901 | A | 3/1999 | Hampton | |
| 5,886,068 | A | 3/1999 | Prout et al. | |
| 5,899,468 | A | 5/1999 | Apps et al. | |
| 5,947,295 | A | 9/1999 | Lutin | |
| D416,367 | S | 11/1999 | Dickinson et al. | |
| D429,398 | S | 8/2000 | Wysocki | |
| D445,228 | S | 7/2001 | Apps et al. | |
| 6,276,557 | B1 | 8/2001 | Wysocki | |
| 6,290,093 | B1 * | 9/2001 | Obriot et al. | 220/835 |
| 6,471,221 | B1 | 10/2002 | McGarry | |
| D465,348 | S | 11/2002 | Lucatello | |
| D471,336 | S | 3/2003 | Tuduri | |
| D471,685 | S | 3/2003 | Taylor et al. | |
| D478,197 | S | 8/2003 | Raghunathan | |
| 6,666,485 | B1 * | 12/2003 | Moret | 292/130 |
| D491,328 | S | 6/2004 | Aiken et al. | |
| 6,843,386 | B2 | 1/2005 | Raghunathan et al. | |
| 6,918,508 | B2 | 7/2005 | Hwang | |
| D515,313 | S | 2/2006 | Uffner et al. | |
| 7,017,773 | B2 | 3/2006 | Gruber et al. | |
| 7,048,346 | B2 | 5/2006 | Saravis | |
| 7,114,631 | B2 | 10/2006 | Aiken | |
| 7,121,564 | B2 | 10/2006 | Hassell | |
| D532,173 | S | 11/2006 | Aiken et al. | |
| D535,448 | S | 1/2007 | Kilduff et al. | |
| 7,172,088 | B2 | 2/2007 | McDade et al. | |
| 7,287,665 | B2 | 10/2007 | Meissen et al. | |
| D577,170 | S | 9/2008 | Meers | |
| 7,540,393 | B2 | 6/2009 | Wong | |
| D600,943 | S | 9/2009 | Austin et al. | |
| D600,944 | S | 9/2009 | McConnell et al. | |
| D624,723 | S | 9/2010 | Raghunathan et al. | |
| D643,174 | S | 8/2011 | Raghunathan et al. | |
| 7,988,009 | B2 * | 8/2011 | Cavalcante | 220/324 |
| 8,028,940 | B2 | 10/2011 | Kelly et al. | |
| D654,723 | S | 2/2012 | Gormezano | |
| D656,730 | S | 4/2012 | Son | |
| 8,360,445 | B2 | 1/2013 | Meers et al. | |
| 8,366,156 | B2 * | 2/2013 | Mercier et al. | 292/80 |
| 8,424,715 | B2 | 4/2013 | Aiken | |
| 8,448,812 | B2 | 5/2013 | Gruber et al. | |
| 8,485,381 | B2 * | 7/2013 | Raghunathan et al. | 220/324 |
| 8,485,382 | B2 | 7/2013 | Raghunathan et al. | |
| 8,511,502 | B2 | 8/2013 | Wong | |
| 2003/0168466 | A1 * | 9/2003 | Spiers et al. | 220/835 |
| 2004/0074913 | A1 | 4/2004 | McDade et al. | |
| 2005/0029763 | A1 | 2/2005 | Hassell | |
| 2006/0065657 | A1 * | 3/2006 | Wong | 220/324 |
| 2006/0076260 | A1 | 4/2006 | Luburic | |
| 2006/0138156 | A1 | 6/2006 | Kellerer et al. | |
| 2006/0236612 | A1 | 10/2006 | Sheng et al. | |
| 2009/0107998 | A1 | 4/2009 | Meissen | |
| 2009/0223965 | A1 | 9/2009 | Raghunathan et al. | |
| 2010/0037565 | A1 | 2/2010 | Meissen | |
| 2010/0108675 | A1 | 5/2010 | Meissen et al. | |
| 2010/0314404 | A1 | 12/2010 | Baltz | |
| 2011/0024430 | A1 | 2/2011 | Meissen et al. | |
| 2011/0049151 | A1 | 3/2011 | Raghunathan et al. | |
| 2011/0049152 | A1 | 3/2011 | Raghunathan et al. | |
| 2011/0274525 | A1 | 11/2011 | Mercier et al. | |
| 2013/0119625 | A1 | 5/2013 | Foster | |
| 2013/0334229 | A1 | 12/2013 | McCanless | |
| 2014/0027454 | A1 | 1/2014 | Banik | |

FOREIGN PATENT DOCUMENTS

| | | | |
|---|---|---|---|
| CA | 2418583 | A1 | 8/2003 |
| CA | 2521412 | A1 | 3/2006 |
| CA | 2330996 | A1 | 8/2007 |
| CA | ID125054 | | 4/2009 |
| CA | ID126678 | | 4/2009 |
| CA | 2624658 | A1 | 9/2009 |
| CA | 2624663 | A1 | 9/2009 |
| CA | 2636306 | A1 | 9/2009 |
| DE | 2646175 | A1 | 4/1978 |
| DE | 29511098 | U1 | 7/1996 |
| EP | 0872432 | A1 | 10/1998 |
| EP | 1081063 | A1 | 3/2001 |
| GB | 2361742 | A | 10/2001 |
| GB | 2453055 | A | 3/2009 |

OTHER PUBLICATIONS

Extended European Search Report for European Application No. EP 14156218.1 mailed Apr. 14, 2014 (8 pages).

* cited by examiner

WASTE CONTAINER WITH GRAVITY LATCH

CROSS-REFERENCE TO RELATED APPLICATIONS

The present application claims the benefit of U.S. Provisional Application Ser. No. 61/768,049 filed Feb. 22, 2013, the contents of which are incorporated herein by reference.

FEDERALLY SPONSORED RESEARCH OR DEVELOPMENT

N/A

FIELD OF THE INVENTION

The present invention generally relates to a latch mechanism for a waste container having a body and a lid pivotably connected to the body; and more particularly to a latch mechanism for a waste container that is gravity activated for use with automatic features or equipment of a waste collection truck.

BACKGROUND OF THE INVENTION

One problem with waste containers that are stored outside and that contain organic materials is the entry of pets, rodents, and vermin. In particular, raccoons have been shown to be very skillful in the art of getting to the contents of communal and commercial waste containers.

Some containers, especially those designated for the collection of organic waste, have elaborate latch mechanisms that make it difficult for animals to actuate, but allow the human user to open and close the lid with one hand for filling.

To save costs, more and more municipalities use automated trucks to collect waste. These trucks are manned by one driver, who operates the unloading of containers via joystick-controlled grab arms and cameras. This means that any latch mechanism on the container needs to be automatically unlatched during dumping because the driver does not leave the truck in normal operation.

One known solution to the problem is to add a sliding weight to the arm of the truck that actuates a latch on the container. A downside to this type of system is that it requires a specialized arm or a modification to existing dump trucks.

To overcome the need to have to modify the dump system, gravity latches have been developed that unlock the lid of a waste container when a certain tilt angle is reached. Known mechanisms include: U.S. Pat. No. 5,094,358 LOCKING MECHANISM FOR CONTAINER LID; U.S. Pat. No. 5,474,341 GRAVITY ACTUATED CONTAINER LOCK; U.S. Pat. No. 5,415,314 GRAVITY LOCKING MECHANISM EMPLOYING FIRST AND SECOND PENDULUMS FOR SECURING THE LID OF A REFUSE CONTAINER; and FRANZEN International offers a gravity lock for trash carts (http://www.franzenint.com/trash-bin-gravity-locks.html).

The present invention provides an improved waste container with a gravity activated latch mechanism.

SUMMARY OF THE INVENTION

The present invention provides a waste container having a container body and a lid pivotably attached to the container body. The waste container is provided with a gravity locking mechanism in the lid for locking the lid to the container body when in an upright position, and for disengaging the lock when the container is inverted (typically by automatic dumping equipment). Inverting the container causes a weight in the mechanism to rotate a lever connected to a latch to disengage the latch and allow the lid to open.

In accordance with one embodiment, a waste container with a gravity locking mechanism is provided. The waste container includes a container body having an open top portion and a catch on a front portion of the top portion. A lid is pivotably connected to the top portion of the container body. A locking mechanism is connected to the lid. The locking mechanism includes a rotatable member having an axis of rotation; a latch configured to engage the catch when the lid is pivoted to a closed position and a weight. A lever connects the rotatable member, latch and weight. The locking mechanism is configured so that placement of the container in an upside down position causes the weight to rotate the lever about the axis of rotation of the rotatable member to disengage the latch from the catch to enable opening of the lid.

The rotatable member can be positioned at a first end of the lever above the latch. The weight can be positioned at a second end of the lever. The weight can be a separate piece of material, such as steel or other similar material, and can be secured to the locking mechanism by a push-in fastener or other similar means. Alternatively, the weight does not have to be a separate piece of material. Instead, the weight can be made from the same material used for the lever and be integrally formed therewith.

The waste container can include a button in a front portion of the lid. The button can be slideably configured to disengage the latch from the catch when the container is in an upright position to enable opening of the lid. A variety of other mechanisms could also be used to allow a user to manually unlatch the lid when upright. For example: a rotatable knob or key, a secondary lever, or a rigid extension of the main lever that protrudes through the lid, or other known means could also be used.

The container body can include wheels connected to a lower portion of the container body to facilitate movement of the container. Additionally, the container body can include features to facilitate use with automatic dumping equipment. The lid can also be provided with a handle.

The lid can also be provided with a cover plate having a portion positioned between the locking mechanism and the container body. The cover plate separates the locking mechanism from the interior of the container body and prevents waste from contacting or otherwise interfering with the locking mechanism.

In accordance with another aspect of the invention, a waste container with a gravity activated latch in the lid is provided. The waste container comprises a container body having a bottom and a sidewall extending upward from the bottom to a top opening. The container body includes an inwardly directed protrusion proximate the top opening. A lid is pivotably connected at a first end to a first side of the top opening of the container body. A lock having a rotatable member is connected to an interior portion of the lid proximate a second end of the lid opposed from the first end. A first arm extends from the rotatable member. The first arm has a latch element for engaging the protrusion on the container body when the waste container is in an upright position and preventing the lid from opening. A second arm extends from the rotatable member toward the interior of the container.

The first arm extends generally vertically downward when the lid is in a closed position over the opening and the waste container is in an upright position. The second arm extends generally horizontally when the lid is in a closed position over the opening and the waste container is in an upright position. The first arm and second arm are preferably at a right angle.

The second arm includes a first end connected to the rotatable member and a second end distal from the rotatable member. A weight is connected to the second arm proximate the second end. The weight can be steel or some other suitable material. The weight is connected to the second arm by a push-in fastener or can be molded into the second arm.

A cover plate can be connected to an interior portion of the lid. The cover plate separates the second arm from the interior of the container body when the lid is in a closed position. The cover plate includes an opening to enable the first arm to engage the protrusion of the container body. The cover plate prevents materials in the container body from interfering with rotation of the lock.

The waste container can further comprise a moveable member connected to one of the lever and the lid, and a locking member connected to the other of the lever and the lid that is engageable with the moveable member to prevent rotation of the rotatable member. The moveable member moves to a locking position when the container is not in one of an upright position and an upside position (e.g., when the container is pushed on its side).

The container body can be formed from plastic or other similar materials. Similarly, the lid can also be formed from plastic or other similar materials.

In accordance with another embodiment of the invention, a waste container with a gravity latch that will not open if the container is moved into an improper position (e.g., on its side) is provided. The waste container comprises a container body having a bottom wall, a side wall extending upward from the bottom wall, and an open top. A lid is pivotably connected to the open top at one end. A gravity locking mechanism having a latch arm, a rotatable hinge portion, a latch connected to a first end of the latch arm and a first weight connected to the latch arm is connected to the lid. The latch is engageable with the container body when the container is in an upright position (keeping the lid locked to the container body) and disengageable with the container body when the container is in an upside down position by rotation of the latch arm due to gravity (allowing the lid to open to dispel any contents of the container body). The waste container further comprises a moveable (e.g., slideable or pivotable) member connected to one of the lid and the latch arm, and a locking member on the other of the lid and the latch arm. The moveable member is configured to move to engage the locking member when the container is not one of upright or upside down (e.g., pushed onto its side) to prevent rotation of the locking mechanism and unwanted opening of the lid. Moreover, the moveable member and locking structure can be used on containers having different gravity or other types of locking mechanisms.

The moveable member can be a second weight having a central opening allowing for slideable movement about a post. The locking structure can be a ledge positioned to engage the weight when the container is moved to an improper position (which causes the weight to slide to an engaging position). The second weight can be positioned on the latch arm (e.g., by the first weight) and the locking structure can be a ledge connected to the lid or a portion of the cover plate.

The waste container can further comprise a spring (such as a torsion spring) connected to the rotatable hinge portion, the latch arm and the latch. This enables movement of the latch with respect to the latch arm upon application of a force on the latch (e.g. by a push button) sufficient to overcome the spring force. This allows for opening of the container regardless of rotation of the latch arm of the locking mechanism (e.g., when the moveable member is engaged with the locking structure).

Further aspects of the invention are disclosed in the Figures and are described herein.

BRIEF DESCRIPTION OF THE DRAWINGS

To understand the present invention, it will now be described by way of example, with reference to the accompanying figures in which.

DETAILED DESCRIPTION

While this invention is susceptible of embodiments in many different forms, there is shown in the Figures and will herein be described in detail preferred embodiments of the invention with the understanding that the present disclosure is to be considered as an exemplification of the principles of the invention and is not intended to limit the broad aspect of the invention to the embodiments illustrated.

Figure 1:
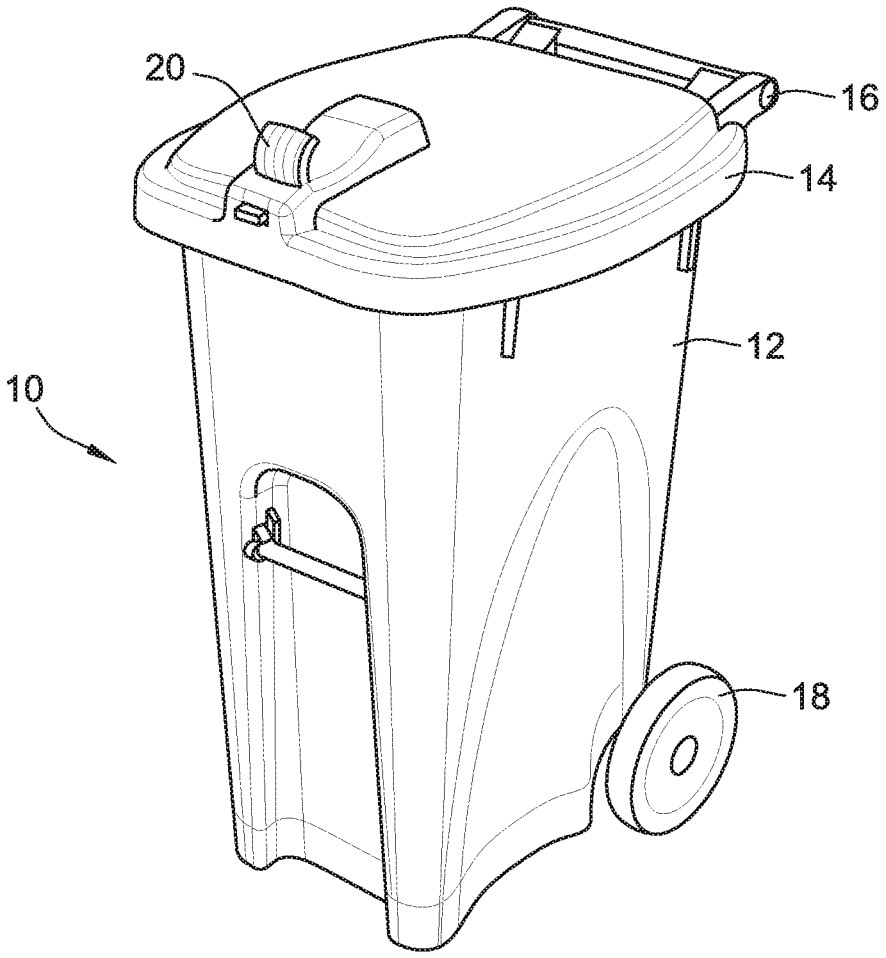
FIG. 1 is a perspective view of a first embodiment of a waste container having a body and lid pivotably connected to the body.

As illustrated in FIG. 1, a waste container 10 includes a container body 12 and a lid 14 pivotably connected at one end to the container body 12 by a hinge element 16. The container body 12 includes a bottom and sidewalls extending upward from the bottom to an open top portion (which can be selectively covered by the lid 14). The container body 12 also includes wheels 18 on a lower portion of the body 12. The lid 14 includes a handle 20 extending from an upper surface of the lid 14. The container body 12 and lid 14 can be formed from plastic or other similar or suitable materials.

Figure 2:
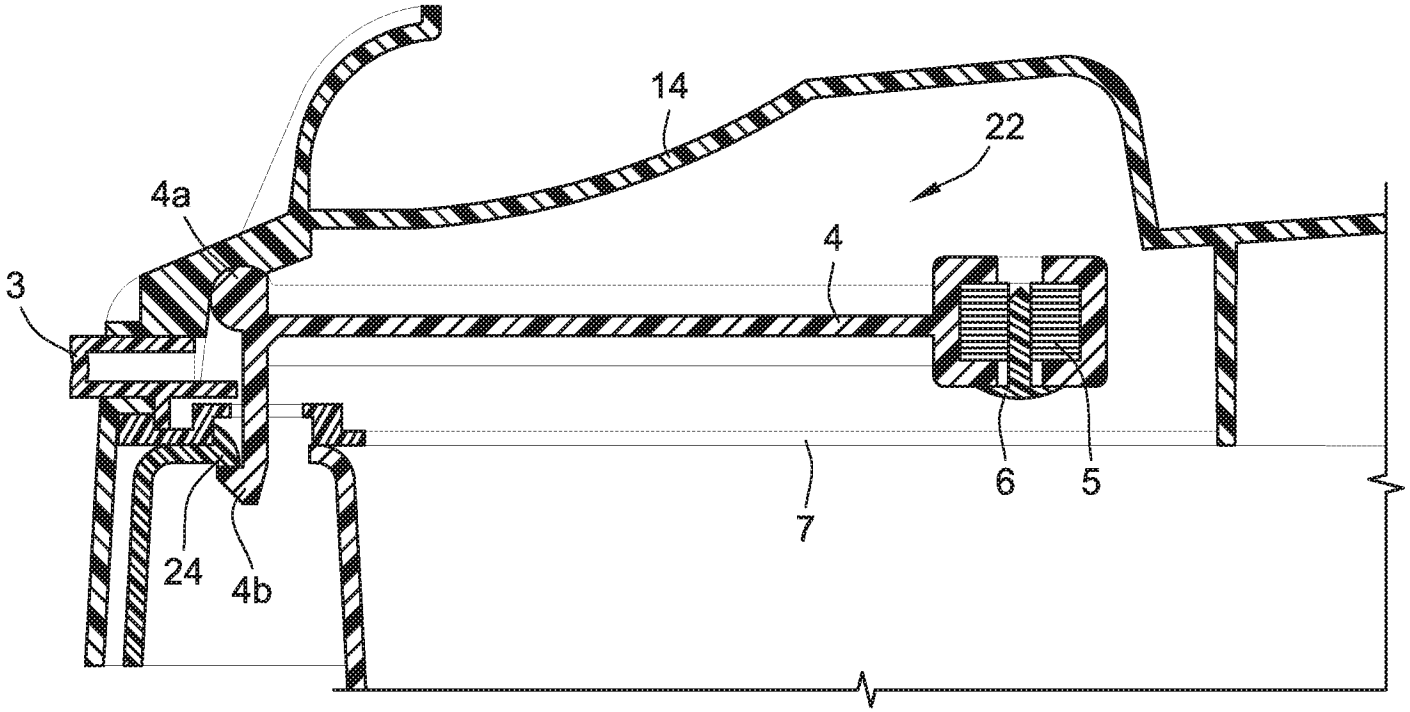
FIG. 2 is a cross-sectional view of a top portion of the container of FIG. 1 showing a latch feature in a latched position.

Referring to the cross-section of FIG. 2, a gravity actuated locking or latching mechanism 22 (i.e., lock) is shown. The mechanism 22 includes a latch lever 4 rotatably mounted to the lid 14 of the waste container 10. At a first end, the lever 4 includes a rotatable member 4*a* having an axis of rotation mounted to the underside of the lid 14 proximate the location of the handle 20. The rotatable member 4*a* having the axis of rotation can be a cylindrical axle or other similar structure that allows rotation of the lever and latch. At a second opposing end, the lever 4 includes a weight 5.

The locking mechanism 22 can be formed primarily out of plastic or other similar or suitable material. However, the weight 5 in the locking mechanism 22 can be steel (or other suitable material) that is fastened to the lever 4 by a push-in fastener 6. Alternatively, the weight 5 could be overmolded into the plastic of the lever 4, or could be fastened to the lever 4 by different means than those shown. Alternatively, the weight can be integrally formed with the lever (e.g., the same material). In this embodiment, the lever can be formed from a material with sufficient weight to enable rotation due to gravity.

A latch hook 4*b* is provided at the first end of the lever 4 below the rotatable member 4*a*. The latch hook 4*b* is designed to cooperate with an inwardly projecting protrusion, such as a catch 24 formed at the top of the container body 12. When the lid 14 is down covering the opening of the container body 12 (i.e., when the waste container 10 is right-side-up) the latch hook 4*b* engages the catch 24 and locks the lid 14 to the container body 12. The weight 5 at the second end of the lever 4 provides a downward force on the end of the lever 4 which causes the rotatable member 4*a* to rotate clockwise (in cross-section) and keeps the latch hook 4*b* in place against the catch 24 in this upright position.

Figure 3:
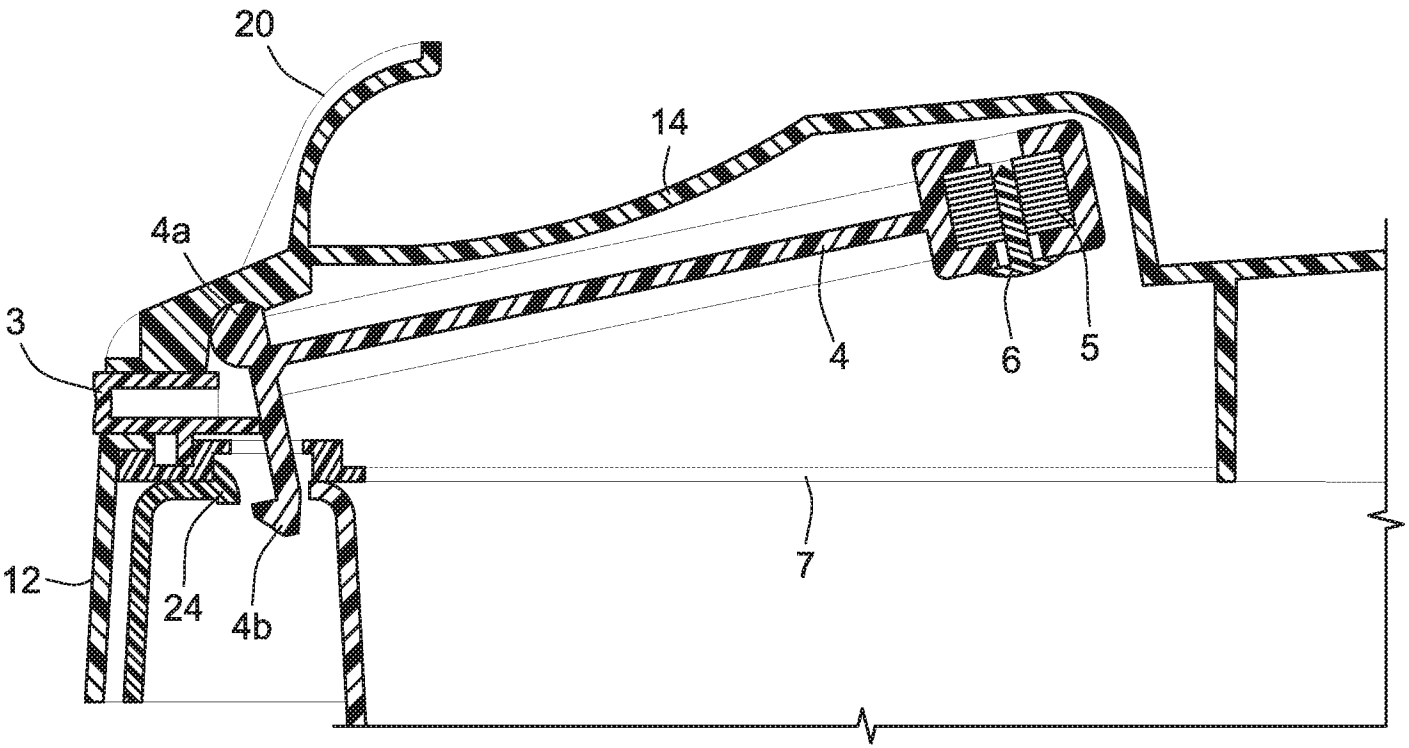
FIG. 3 is a cross-sectional view of the top portion of the container of FIG. 1 showing the latch mechanism in an unlatched position.

A push button 3 is slideably mounted at the front of the lid 14 to enable a user to manually disengage the latch hook 4*b* and open the lid 14 when the waste container 10 is in the upright position. As illustrated in FIG. 3, pushing in the button 3 pivots the latch hook 4*b* back and upward to disengage the catch 24 on the container body 12. The force to push the button 3 in this embodiment is affected by the weight 5, the distance from the weight 5 to the axis of rotation 4*a*, and the distance from the axis of rotation 4*a* to the point where the button 3 makes contact with the latch hook 4*b*. The amount of force needed to open the lid 12 can be adjusted by altering any of these three variables. The lid 14 is provided with a space for the weight 5 in the pivoted-unlatched position. When the lid 14 is lowered, the latch 4*b* will reengage the catch 24 and lock the lid 14 to the container body 12.

A cover plate 7 is positioned below the lever 4. A portion of the cover plate 7 separates the locking mechanism 22 from the interior of the waste container body 12. This protects the locking mechanism from contacting waste placed in the container, and prevents such waste from interfering with the mechanism during operation.

Figure 4:
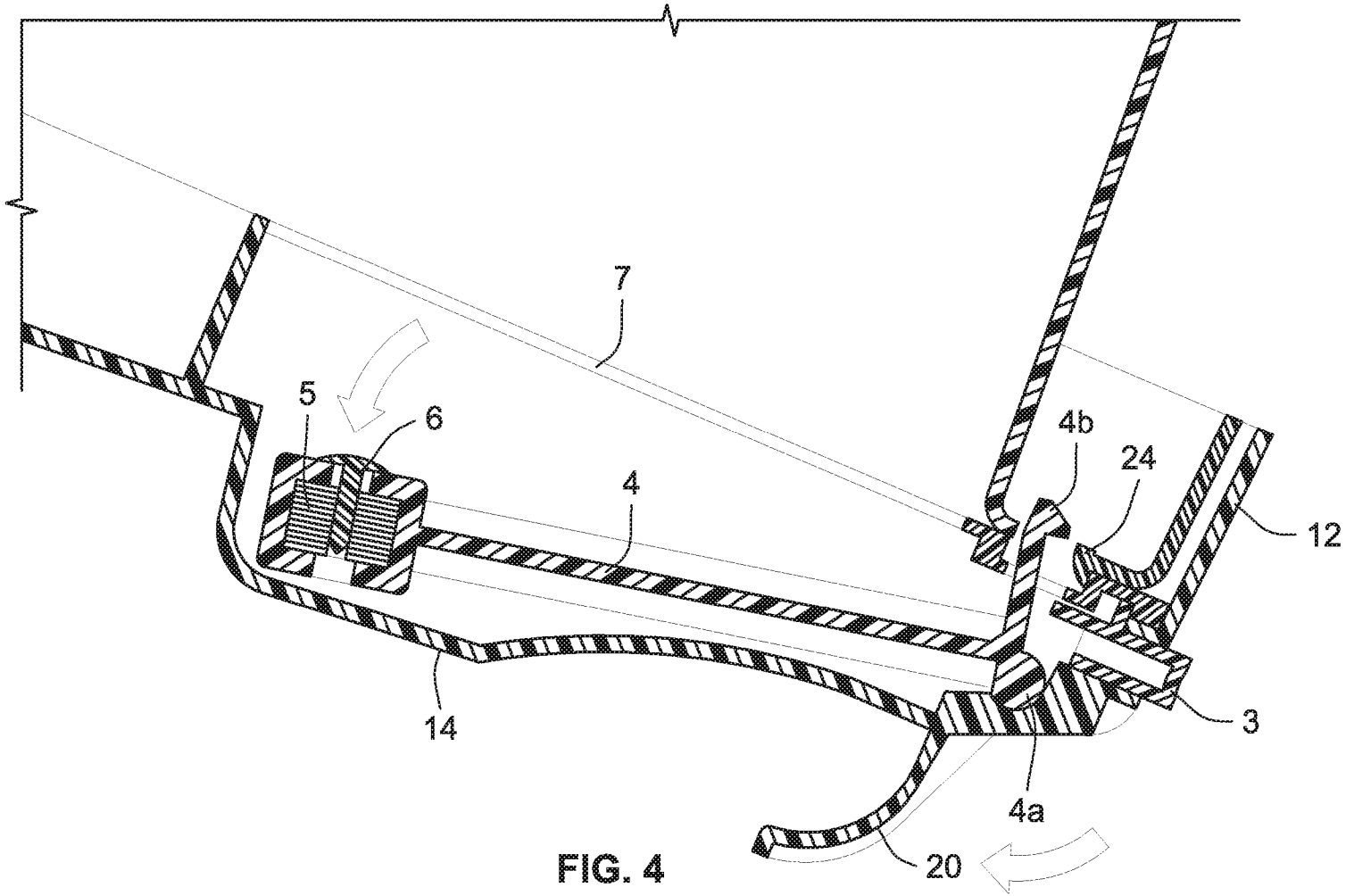
FIG. 4 is a cross-sectional view of the top portion of the container of FIG. 1 showing how gravity operates the latch mechanism to move it to the unlatched position to allow the lid to open during an automatic dumping operation.
Figure 5:
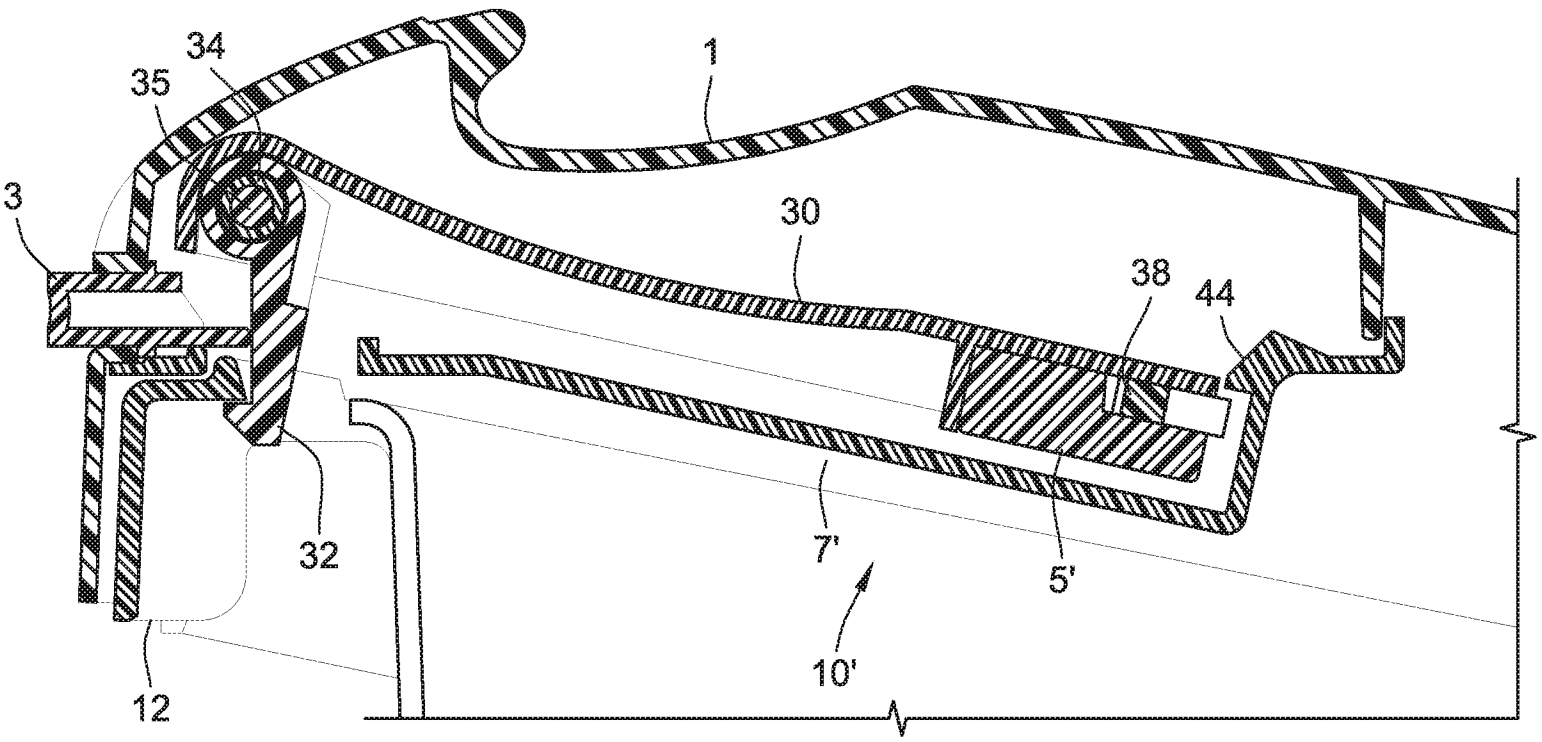
FIG. 5 is a cross-sectional plan view of the top portion of a second embodiment of a waste container having a body and lid pivotably connected to the body in an upright position.
Figure 6:
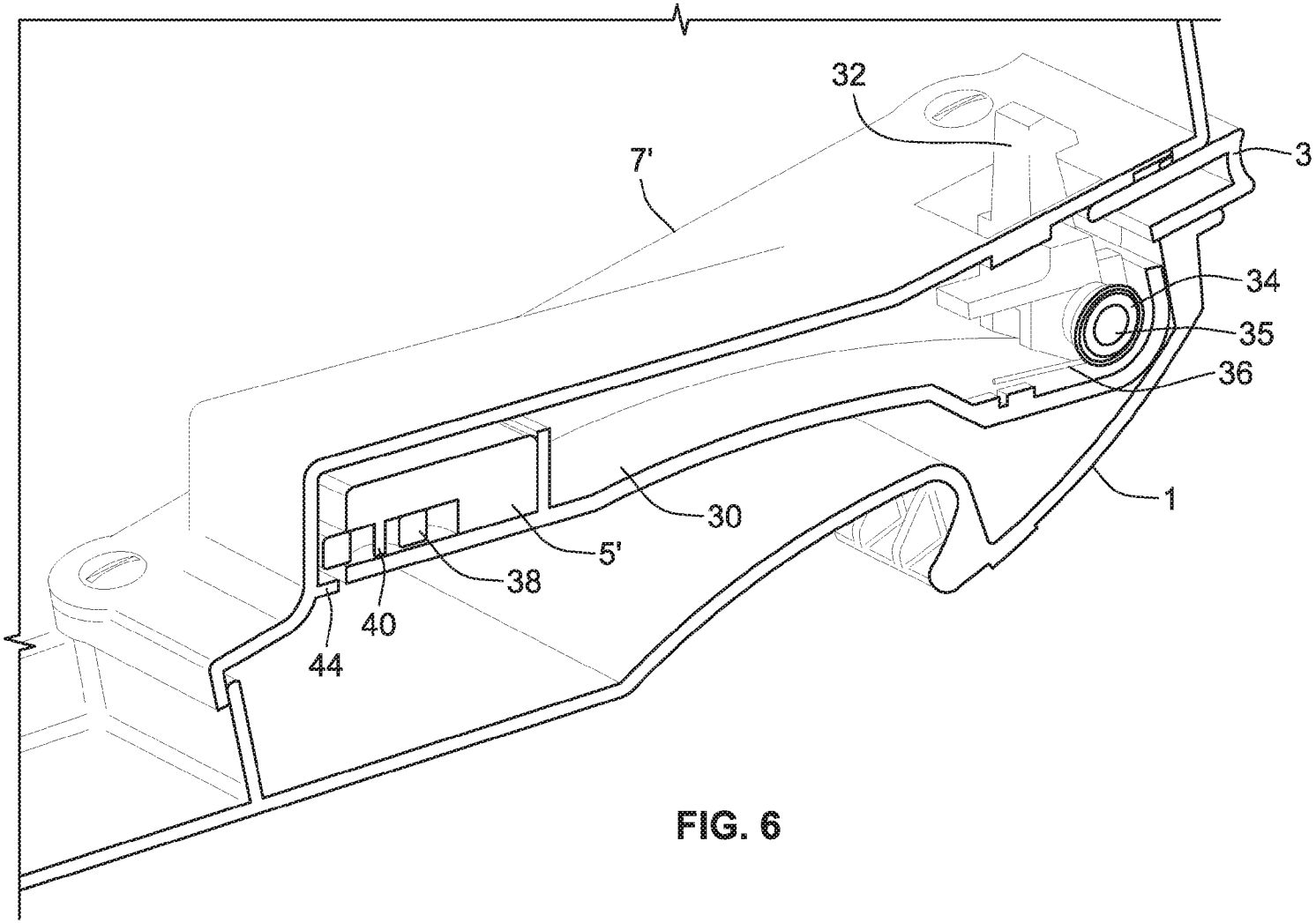
FIG. 6 is perspective cross-sectional view of the top portion of the container of FIG. 5 in an inverted position.

The locking mechanism 22 is configured to automatically (i.e., via gravity) unhook the latch hook 4*b* when the container 10 is turned upside down (e.g., by a waste disposal vehicle or other similar apparatus). As illustrated in FIG. 4, when the container 10 is turned upside down, the weight 5 causes the lever 4 to pivot about the axis of rotation 4*a* in a counter-clockwise direction which disengages the latch hook 4*b* from the catch 24. This allows the lid 14 to open under gravity.

As illustrated in FIGS. 1-4, the lever 4 has a first vertical arm (when the lid is closed and the container is in an upright position) extending downward from the rotatable member 4*a* with the latch at an end of the arm, and a horizontal arm extending from the rotatable member 4*a* toward an interior of the waste container. The weight 5 is at a distal end of the second arm. The first and second arms form a right angle at the rotatable member 4*a*.

One potential shortcoming of the waste container 10 shown in FIGS. 1-4, is that the design may not prevent the lid 14 from opening when the container falls over on its side (e.g., accidentally by a person placing waste in the container, or by a raccoon or other animal attempting to get inside). In such instances, gravity or other centrifugal forces may pivot the weighted latch lever 4 out of its locked position, which can result in the unintentional opening of the lid 14. This can lead to spillage of, or access to, the contents of the container 10.

FIGS. 5-11 illustrate another embodiment of a waste container 10' with a gravity latch mechanism. The waste container 10' includes a lid 1 pivotably connected at one end to a container body 12.

The lid 1 includes a gravity actuated locking or latching mechanism 22' having a latch arm 30 and a separate latch hook 32 (that is, unlike the container of FIGS. 1-4, the latch arm 30 and latch hook 32 are two separate pieces). The latch arm 30 and latch hook 32 are connected through a hinge tube 34 surrounding an axle 35. The axle 35 is fastened to the lid 1 and allows the latch arm 4 and hook 32 to rotate together about the axle 35 in the manner discussed above.

Figure 7B:
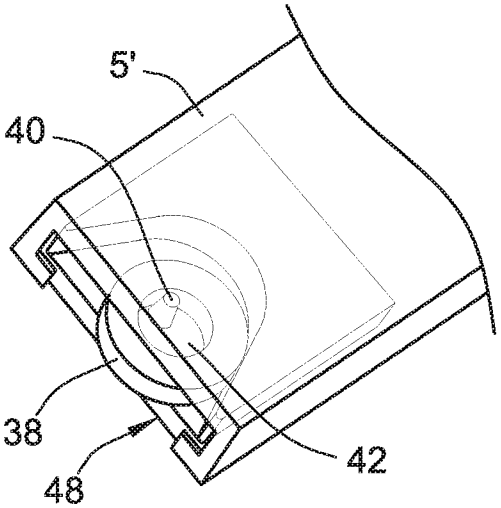
FIGS. 7A, 7B and 7C are perspective views of a secondary weight used in the container of FIG. 5 in a first position, a second position and a third position, respectively.
Figure 7C:
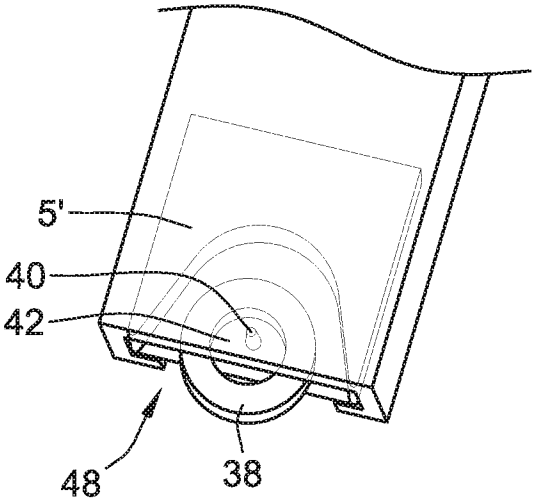
Figure 7A:
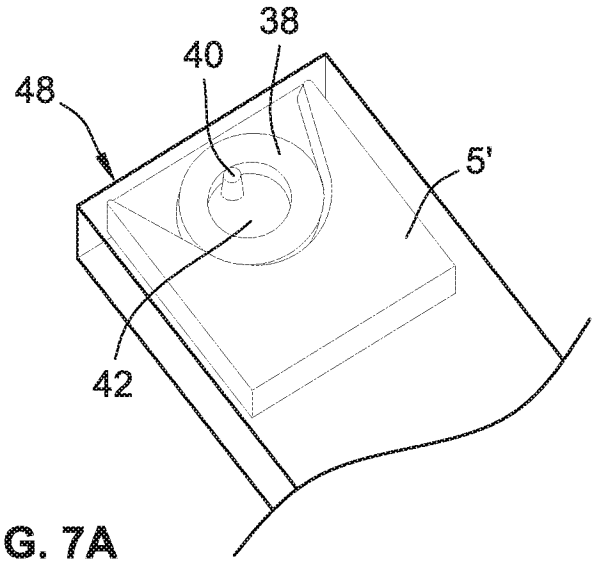
Figure 8:
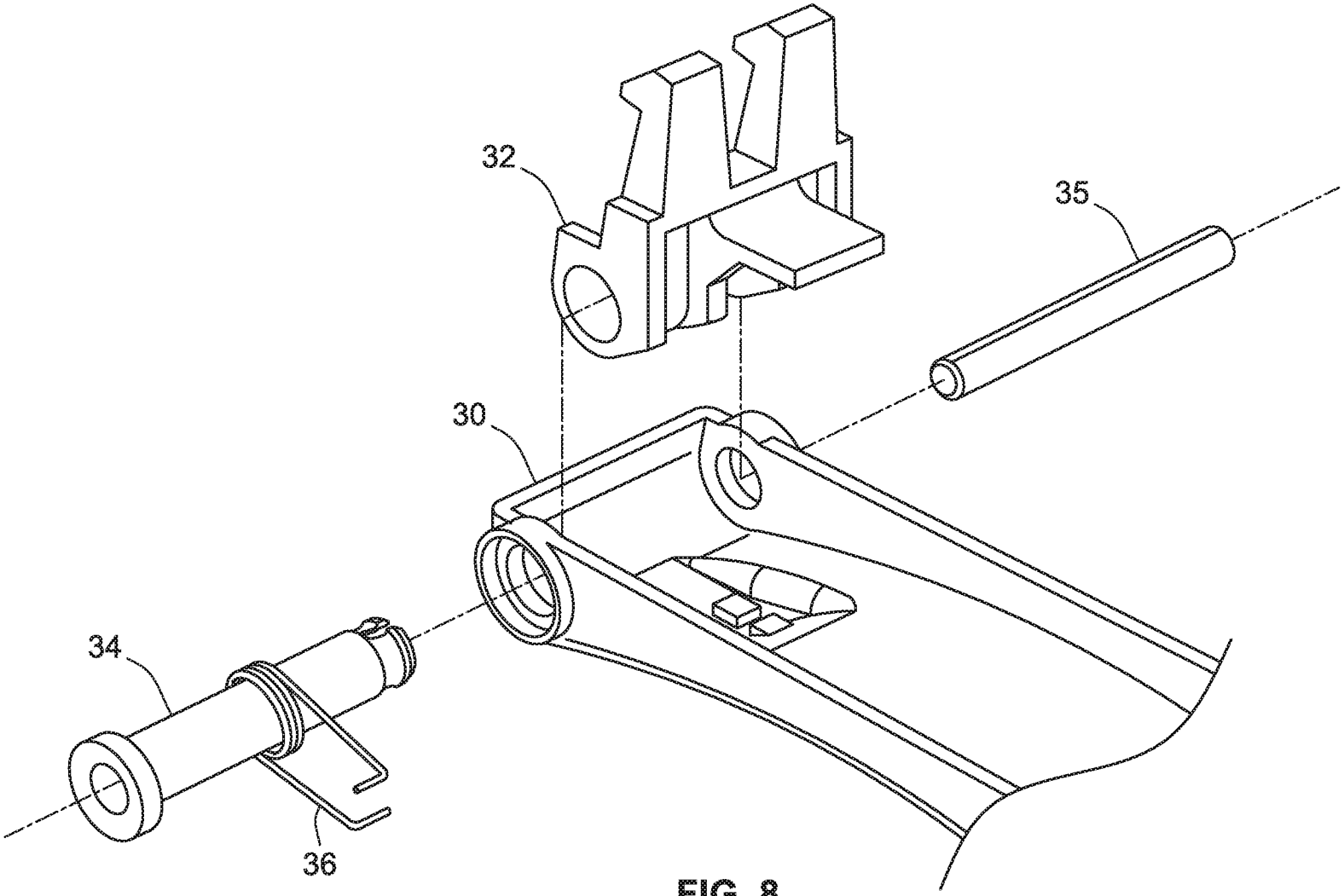
FIG. 8 is an exploded view of a pivoting end of a latch arm of the container of FIG. 5.

Additionally, the latch hook 32 in the embodiment of FIGS. 5-11 can move (i.e., rotate) relative to the latch arm 30 by a small amount (approximately 12° to 15°). A torsion spring 36 surrounds the hinge tube 34 and exerts a rotational force between the latch arm 30 and the latch hook 32. The torsion spring 36 is configured to bias the hook 32 to extend generally perpendicular to the latch arm 30. An exploded view of these components (i.e., the pivoting end of the latching mechanism 22') is shown in FIG. 8. Although a torsion spring is shown, other types of springs or spring-like elements (e.g., compression or elastomeric springs) can be used.

A first, primary weight 5' is connected to the latch arm 30 at an end of the latch arm 4 distal from the end proximate the hook 32. The first primary weight 5' functions in the same manner as the weight 5 shown with respect to the embodiment in FIGS. 1-4. That is, the weight 5' causes the latch arm 30 and hook 32 to engage the catch 24 on the container body 12 when in the upright position and to rotate the latch arm 30 and hook 32 when upside down, enabling the lid 1 to open.

In addition to the first primary weight, the latching mechanism 22' of the embodiment of FIGS. 5-11 includes a second, secondary weight 38. The second weight 38 is shaped like a ring washer having a central opening 42. As illustrated in FIGS. 6 and 7A-C, the center of the second weight 38 is positioned over a post or projection 40 extending from a portion of the first weight 38.

A cover plate 7' separates the mechanism 22' from the interior of the container body 12. The cover plate 7' includes a ledge 44 positioned above the first and second weights 5' and 38 (i.e., in the direction of rotation of the weights) as shown, for example, in FIG. 6. In this regard, the ledge 44 can be any other locking feature or structure that is capable of engaging the weight 38 (when it has moved to an appropriate position as discussed herein) and preventing the latch arm from rotating.

As illustrated in FIGS. 7A-C, the second or secondary weight 38 can slide freely about the projection 40 in a generally U-shaped pocket 48 formed by the primary weight 5' and the latch arm 30. In this regard, weights having other shapes with a central opening can also be used.

FIGS. 7A-C show the position of the secondary weight 38 relative to the primary weight 5' (which is locked in position with respect to the latch arm 30), depending on the orientation of the cart 12. FIG. 7A shows the secondary weight 38 in a first position—wherein the weight 38 rests along a bottom of the U-shaped pocket 48—when the container 12 is in an upside down position for dumping its contents. FIG. 7B shows the secondary weight 38 in a second position—wherein the weight 38 rests along one of the sides of the U-shaped pocket 48—when the container 12 is laying on one of its sides. FIG. 7C shows the secondary weight 38 in a third position—wherein the weight 38 is not resting against the walls of the U-shaped pocket 48—when the container 12 is in a normal upright position (or laying on its back with the handle down).

When the container is moved sideways or backward the secondary weight 38 extends beyond the edge of the U-shaped pocket 48 and the back edge of the primary weight 5'—as is the case of FIGS. 7B and 7C. In these instances, the secondary weight 38 catches the ledge 44 and prevents the latch arm 4 and hook 32 from rotating because of the primary weight 5' and thus keeps the lid 1 locked to the container body 12.

Figure 9:
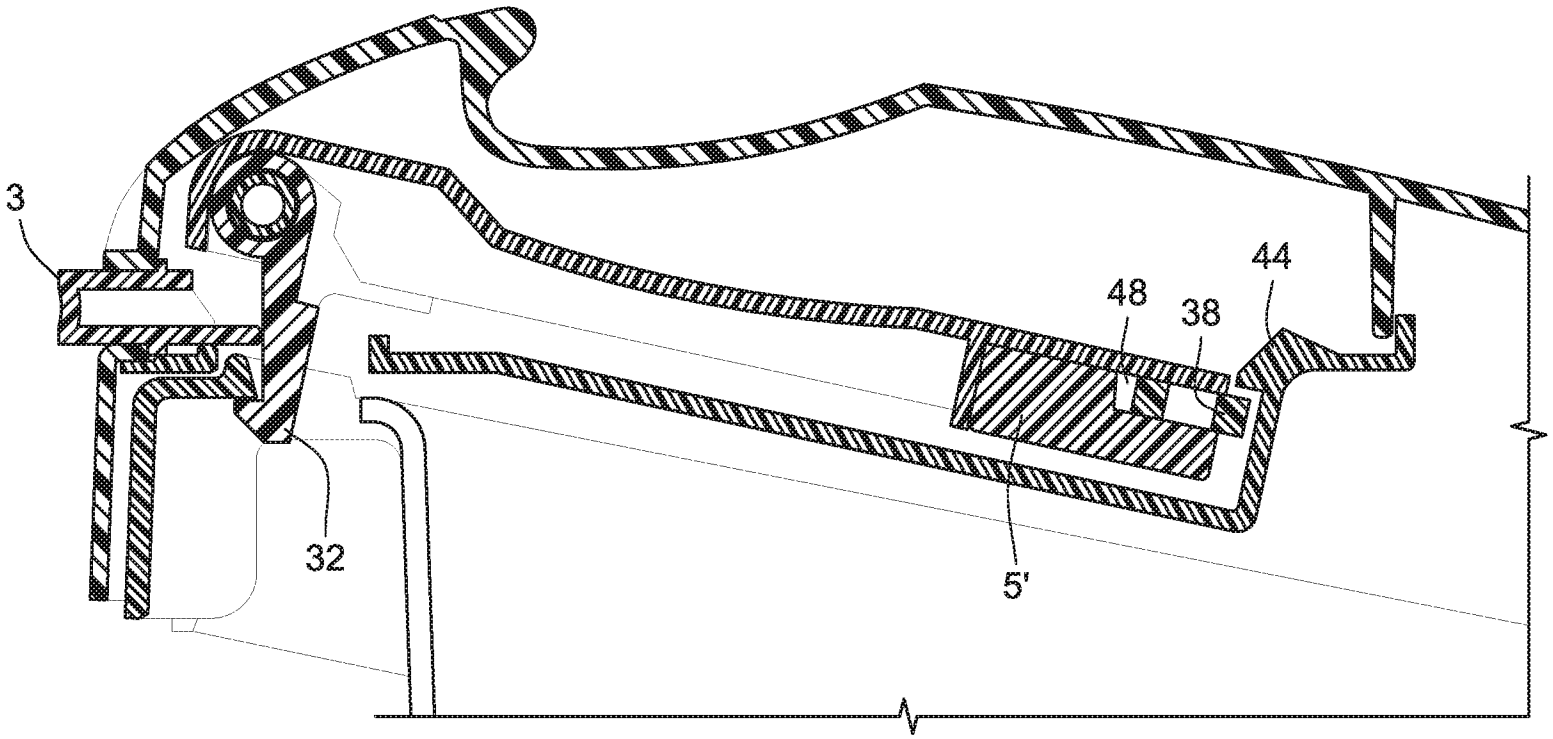
FIG. 9 is a cross-sectional view of the container of FIG. 5 with the secondary weight positioned to catch the ledge and prevent the latch arm from rotating (e.g., when the container is on its side or back)

FIG. 9 illustrates operation of the secondary weight 38 when the container is on its side or back. As shown, the secondary weight 38 moves to the edge of the pocket 48 formed by the primary weight 5'. In this position, a portion of the secondary weight 38 is positioned under the ledge 44 in the cover plate 7'. This portion will contact the ledge 44 and prevent the latch arm 30 from rotating, and in turn, rotating the latch 32, keeping the lid 1 in a closed position.

Figure 10:
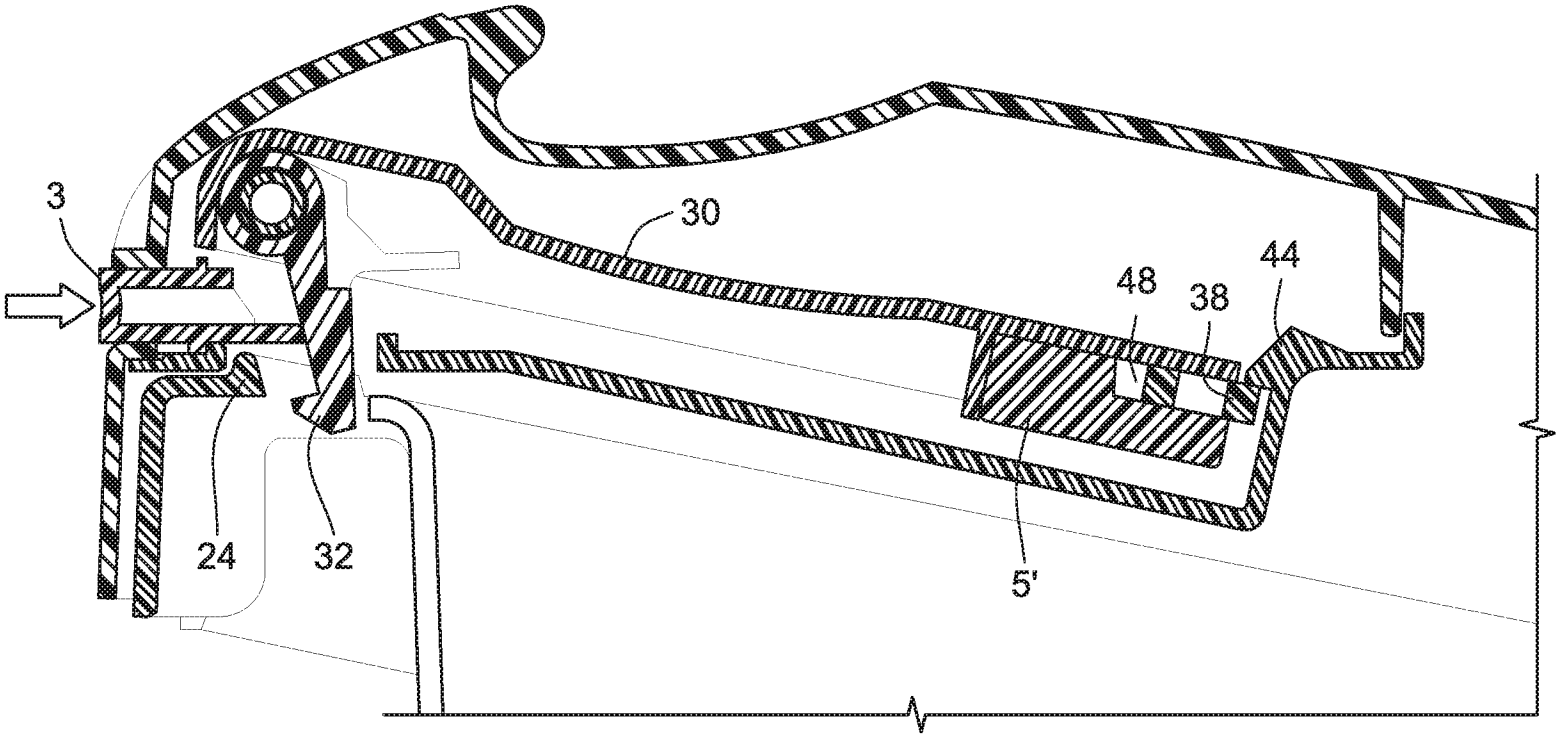
FIG. 10 is a cross-sectional view of the container of FIG. 9 with button depressed to unlatch the lid by independently rotating and moving the hook with respect to the latch arm.

As illustrated in FIG. 10, the lid 1 can still be opened in such situations by utilizing the push button 3—even if the secondary weight 38 catches the ledge 44 (which prevents the latch arm 30 from rotating). This is because the hook 32 is a separate component from the latch arm 30 (i.e., it is not rigidly connected to or an integral part of the latch arm as in the embodiment of FIGS. 1-4) and can move independently from the latch arm 30. As discussed above, the hook 32 is connected to the latch arm 30 via the hinge tube 34, axle 35 and torsion spring 36, and therefore can rotate relative to the latch arm 30. The force needed to push the button 3 and move the hook 30 is determined by the strength of the torsion spring 36.

Figure 11:
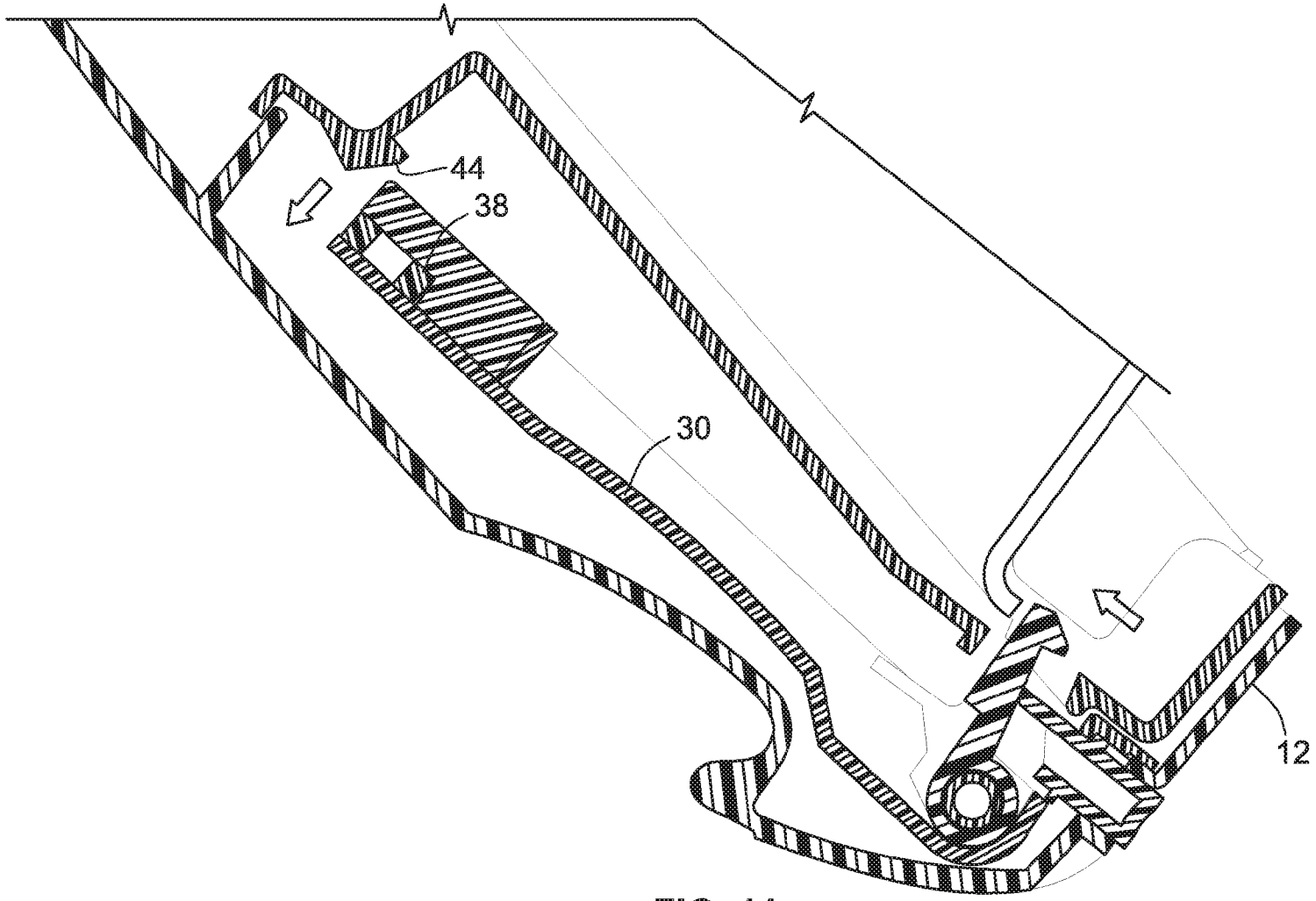
FIG. 11 is a cross-sectional view of the container of FIG. 9 in an upside down position showing the secondary weight allowing the latch arm to rotate.

As illustrated in FIG. 11, when the container is upside down, the secondary weight 38 slides to a position in the pocket 48 that does not overlap the ledge 44. Accordingly, the primary weight 5' will cause the latch arm 30 to rotate—which will cause the hook 32 to rotate and unlatch the lid 1 from the container body 12.

While the secondary weight is shown as a ring with a central opening, other shapes or configurations can be used. Moreover, the secondary weight could be replaced with a pivoting member or mechanism, or some other similar moveable member or mechanism. Additionally, the moveable and locking structures could be reversed so that the secondary weight, or other pivotable or moveable member or mechanism, can be connected to the lid and can engage a ledge or other type of locking member on the latch arm.

Many modifications and variations of the present invention are possible in light of the above teachings. It is, therefore, to be understood within the scope of the appended claims the invention may be protected otherwise than as specifically described.

We claim:

1. A waste container comprising:

a container body having an open top portion and a catch on a front portion of the top portion;

a lid pivotably connected to the top portion of the container body;

a locking mechanism connected to the lid, the locking mechanism including a rotatable member having an axis of rotation; a latch configured to engage the catch when the lid is pivoted to a closed position, a first weight and a lever connecting the rotatable member, wherein placement of the container in an upside down position causes the first weight to rotate the lever about the axis of rotation to disengage the latch from the catch to enable opening of the lid; and, a moveable member comprising a moveable second weight having a central opening over a post, the moveable member connected to one of the lever and the lid, and a locking member connected to the other of the lever and the lid that is engageable with the moveable member to prevent rotation of the rotatable member, wherein the moveable member moves to a locking position when the container is not in one of an upright position and an upside down position.

2. The waste container of claim 1 wherein the first weight is secured to the locking mechanism by a push-in fastener.

3. The waste container of claim 1 further comprising a button in a front portion of the lid configured to disengage the latch from the catch when the container is in an upright position to enable opening of the lid.

4. The waste container of claim 1 further including a cover plate separating the locking mechanism from an interior of the container body.

5. The waste container of claim 1 wherein the moveable second weight has a circular outer perimeter shape.

6. The waste container of claim 1 wherein the rotatable member is at a first end of the lever.

7. The waste container of claim 6 wherein the latch extends from the first end of the lever.

8. The waste container of claim 7 wherein the first weight is at a second end of the lever.

9. A waste container comprising:

a container body having a bottom and a sidewall extending upward from the bottom to a top opening, the container body including an inwardly directed protrusion proximate the top opening;

a lid pivotably connected at a first end to a first side of the top opening of the container body;

a lock including a rotatable member connected to an interior portion of the lid proximate a second end of the lid opposed from the first end, a first arm extending from the rotatable member, the first arm having a latch element for engaging the protrusion on the container body when the waste container is in an upright position and preventing the lid from opening, and a second arm extending from the rotatable member; and, a moveable member connected to the second arm and a locking member connected to the lid that is engageable with the moveable member to prevent rotation of the rotatable member, wherein the moveable member has a central opening allowing for slideable movement about a post and moves to a locking position when the container is not in one of an upright position and an upside down position.

10. The waste container of claim 9 further comprising a cover plate connected to an interior portion of the lid, the cover plate separating the second arm from the interior of the container body when the lid is in a closed position.

11. The waste container of claim 9 wherein the first arm extends generally vertically downward when the lid is in a closed position over the opening and the waste container is in an upright position.

12. The waste container of claim 11 wherein the second arm extends generally horizontally when the lid is in a closed position over the opening and the waste container is in an upright position.

13. The waste container of claim 12 wherein the first arm and second arm are at a right angle.

14. The waste container of claim 12 wherein the second arm includes a first end connected to the rotatable member and a second end distal from the rotatable member, the second arm including a first weight proximate the second end.

15. The waste container of claim 14 wherein the first weight is connected to the second arm by a push-in fastener.

16. The waste container of claim 14 wherein the first weight is molded into the second arm.

17. A waste container with a gravity latch comprising:

a container body having a bottom wall, a side wall extending upward from the bottom wall, and an open top;

a lid pivotably connected to the open top;

a gravity locking mechanism having a latch arm, a rotatable hinge portion, a latch connected to a first end of the latch arm and a first weight connected to the latch arm, the latch engageable with the container body when the container is in an upright position and disengageable with the container body when the container is in an upside down position by rotation of the latch arm due to gravity;

a moveable member connected to one of the lid and the latch arm and a locking member on the other of the lid and the latch arm, wherein the moveable member engages the locking member when the container is not one of upright or upside down to prevent rotation of the locking mechanism, wherein the moveable member is a second weight having a central opening allowing for slideable movement about a post and the locking member is a ledge positioned to engage the weight.

18. The waste container of claim 17 wherein the second weight having a generally circular outer perimeter.

19. The waste container of claim 17 wherein the second weight is positioned on the latch arm and the locking member is a ledge connected to the lid.

20. The waste container of claim 17 further comprising a spring connected to the rotatable hinge portion, the latch arm and the latch, wherein application of a force on the latch sufficient to overcome the spring enables rotational movement of the latch with respect to the latch arm.

* * * * *